US008636038B2

(12) United States Patent
Kusakari et al.

(10) Patent No.: US 8,636,038 B2
(45) Date of Patent: Jan. 28, 2014

(54) OPERATING METHOD OF REINFORCING BAR BINDING MACHINE

(75) Inventors: Ichiro Kusakari, Tokyo (JP); Takahiro Nagaoaka, Tokyo (JP); Tsuyoshi Kobayashi, Tokyo (JP); Akira Kasahara, Tokyo (JP)

(73) Assignee: Max Co., Ltd., Tokyo (JP)

( * ) Notice: Subject to any disclaimer, the term of this patent is extended or adjusted under 35 U.S.C. 154(b) by 565 days.

(21) Appl. No.: 12/953,608

(22) Filed: Nov. 24, 2010

(65) Prior Publication Data

US 2011/0146833 A1 Jun. 23, 2011

(30) Foreign Application Priority Data

Dec. 17, 2009 (JP) ..... 2009-286220

(51) Int. Cl.
*B21F 11/00* (2006.01)
*B21F 9/00* (2006.01)
*B21F 9/02* (2006.01)

(52) U.S. Cl.
USPC ..... 140/123.6; 140/93.2; 140/57

(58) Field of Classification Search
USPC ..... 140/57, 119, 123.6, 118, 93.2, 93.6
See application file for complete search history.

(56) References Cited

U.S. PATENT DOCUMENTS

| | | | | |
|---|---|---|---|---|
| 4,252,157 | A * | 2/1981 | Ohnishi | 140/119 |
| 5,778,946 | A * | 7/1998 | Pellenc et al. | 140/119 |
| 5,871,036 | A * | 2/1999 | Murayama et al. | 140/119 |
| 8,127,803 | B2 * | 3/2012 | Kusakari | 140/123.6 |
| 2008/0110354 | A1 * | 5/2008 | Itagaki et al. | 100/31 |
| 2010/0147411 | A1 * | 6/2010 | Kusakari et al. | 140/119 |

FOREIGN PATENT DOCUMENTS

| | | |
|---|---|---|
| JP | 2008-25252 | 2/2008 |

* cited by examiner

*Primary Examiner* — Dana Ross
*Assistant Examiner* — Mohammad I Yusuf
(74) *Attorney, Agent, or Firm* — Drinker Biddle & Reath LLP

(57) ABSTRACT

An operation method of a reinforcing bar binding machine includes an initializing operation. During the initializing operation, a cutter of a wire cutting mechanism shuts off a wire passageway, a wire is fed by a wire feed mechanism while the wire passageway remains shut off, and the wire feed mechanism is stopped when a leading end of the wire butts against the cutter.

7 Claims, 6 Drawing Sheets

OPERATING METHOD OF REINFORCING BAR BINDING MACHINE

BACKGROUND OF THE INVENTION

1. Field of the Invention

The present invention relates to an initializing method of a reinforcing bar binding machine before binding a reinforcing bar after replacement of a wire reel.

2. Related Art

Generally, in a reinforcing bar binding machine, a wire is fed from a wire reel and wound around reinforcing bars, and the wire is cut by a wire cutting portion. A portion of the wire wound around the reinforcing bars is gripped and twisted, thereby the reinforcing bars is bound (refer JP-A-2008-025252). When a remaining wire in the wire reel becomes empty and a new wire reel is loaded, the reinforcing bar binding machine must be initialized before binding the reinforcing bars. On this occasion, after loading of the new wire reel, a leading edge of a wire must be positioned. Ina conventional reinforcing bar binding machine, a feed means feeds a wire in a small amount after loading of the wire reel, and the wire cutting portion cuts the wire, thereby positioning the leading edge of the wire. Through these operations, a specified amount of wire can be fed even in a first binding operation subsequent to replacement of the wire reel, and stable binding operation becomes feasible.

However, when a wire is cut after the wire has been fed in a small amount by the feed means every time the reinforcing bar binding machine is initialized at the time of replacement of a wire reel, a snippet of the wire turns into rubbish; thus, the wire is uselessly consumed. Moreover, there is a potential of the wire snippet being left in a curl guide located at an extremity of a binding machine main body, to thus cause wire jams. Moreover, if small pieces of the wire are left at a building site, the small pieces will be mixed into concrete during pouring of the concrete. The small pieces of the wire will later rust, whereupon a surface of the concrete will turn into a yellow or swell, to thus cause cracks. For these reasons, the building site must be cleaned up with utmost attention so as to prevent the small pieces of the wire from being left in the building site.

Accordingly, conceivable countermeasures are to feed the wire by worker's hand and to perform only idling of the wire cutting portion without automatically feeding the wire by the feed means during initializing operation.

However, when the user sends the wire to a position ahead of a cutter, the wire will actually be cut. As a result, a small piece of the wire will be left in the binding machine main body; thus, the countermeasures encounter a problem of a binding failure being caused by wire jams. Further, if the wire is inserted in an insufficient amount during setting operation, an extent to which the wire is fed by single binding operation after initialization will be reduced, and a frequency of occurrence of screw-thread cutting will increase.

For these reasons, under both of these methods, it is necessary to provide a user in advance with an instruction for a wire position to be taken during replacement of a wire reel, thereby letting the user understand the instruction. The user is also required to load the wire reel according to the instruction. Therefore, if the user is not provided with an instruction for handling or if the user forgets the instruction, any of the previously mentioned problems will occur.

SUMMARY OF THE INVENTION

The present invention provides an initializing method of a reinforcing bar binding machine that enables aligning of a leading edge of a wire to a fixed position during replacement of a wire reel without requiring a user to perform precise setting of the leading edge of the wire and without generating a snippet of the wire.

According to one or more embodiments of the invention, in an operating method of a reinforcing bar binding machine including a wire feed mechanism for feeding a wire from a wire reel rotatably disposed in a binding machine main body and a wire cutting mechanism that cuts, after the wire has been fed and wound around the reinforcing bars, the wire at a position between a portion of the wire wound around reinforcing bars and the wire reel, the operating method is provided with an initializing operation, wherein the initializing operation includes: shutting off a wire passageway by a cutter of the wire cutting mechanism; feeding the wire by the wire feed mechanism while the wire passageway remains shut off; and deactivating the wire feed mechanism when a leading end of the wire butts against the cutter.

DETAILED DESCRIPTION OF THE EXEMPLARY EMBODIMENTS

By reference to FIGS. 1 through 6, a reinforcing bar binding machine and an operation method of the reinforcing bar binding machine of an exemplary embodiment of the present invention are described.

Figure 1:
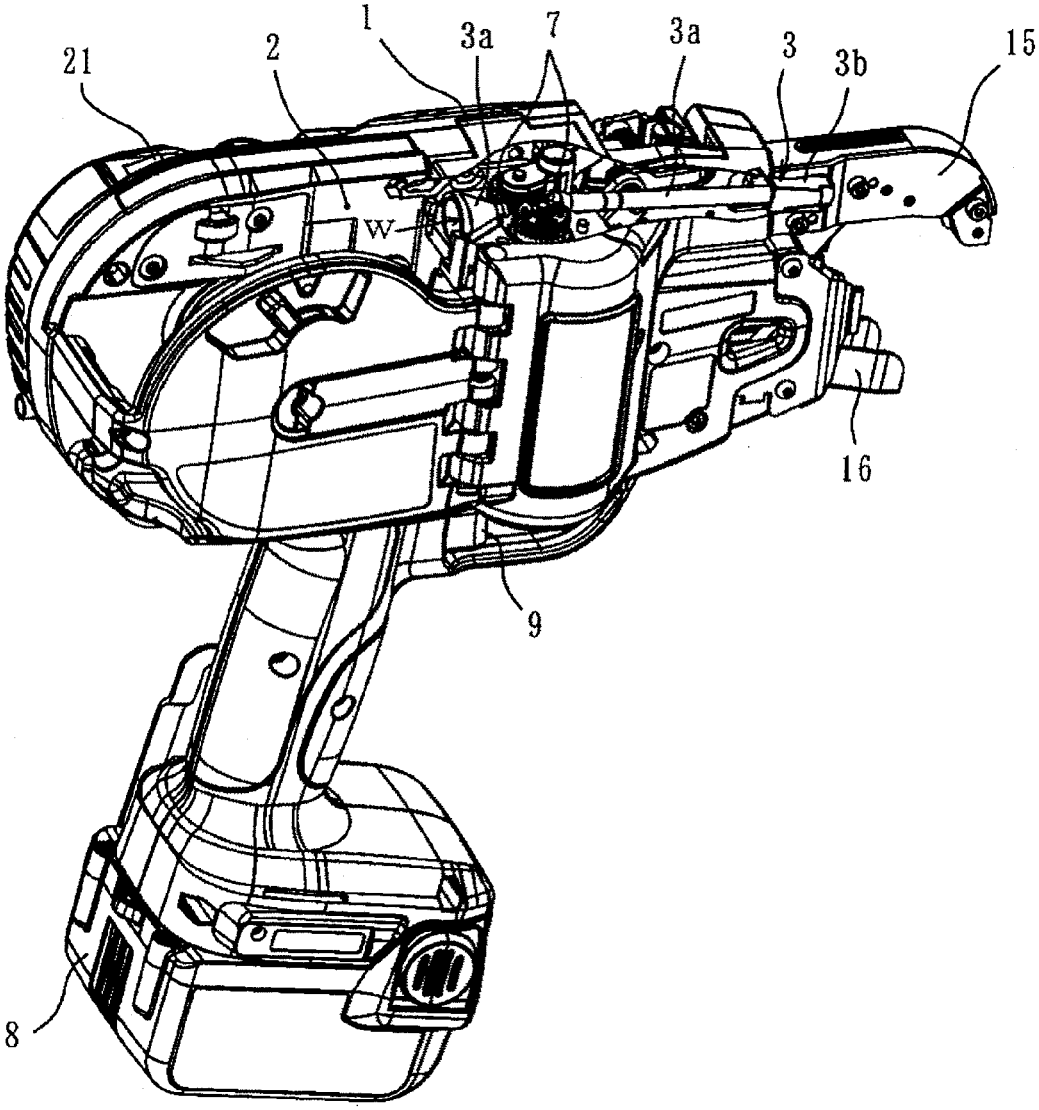
FIG. 1 is an oblique perspective view of a reinforcing bar binding machine of an exemplary embodiment of the present invention.
Figure 2:
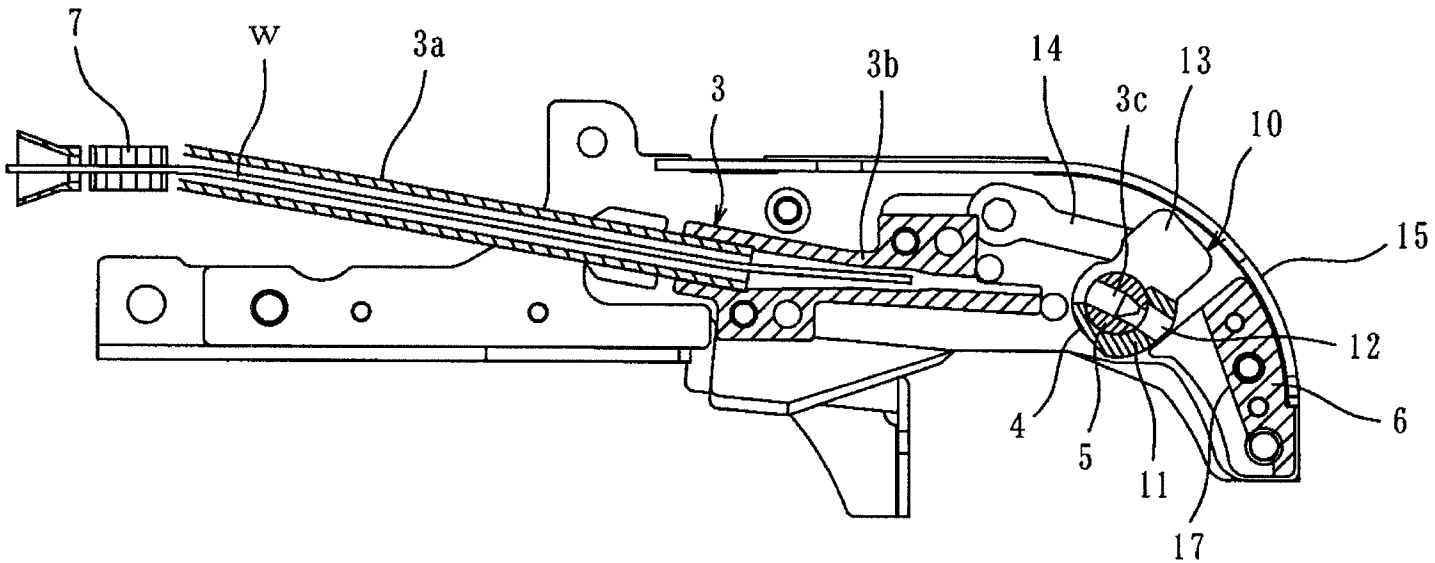
FIG. 2 is a descriptive view of an internal mechanism of a wire cutting portion of the reinforcing bar binding machine shown in FIG. 1.

As shown in FIGS. 1 and 2, a reinforcing bar binding machine includes a binding machine main body 1. A wire reel (not shown) is removably attached to the binding machine main body 1. A wire reel storage space 2 is formed in a rear portion of the binding machine main body 1. A binding wire passageway 3 (see FIGS. 2 and 3) is provided in a front portion of the storage space 2. The wire passageway 3 includes a guide pipe 3*a* that is larger in diameter than a wire; a constricted passageway 3*b* that is connected to a front side of the guide pipe 3*a* and that is constricted in such a way that a cross-sectional area of the passageway becomes smaller than that of the guide pipe 3*a*; a wire through hole 3*c* formed in a cutting piece 5 of a wire cutting portion 4 provided on a front side of the constricted passageway 3*b*; and a curl guide 6 disposed on a front side of the wire through hole 3*c*.

A pair of feed gears 7 working as a wire feed mechanism are provided in an arbitrary position of the guide pipe 3*a*. The wire is nipped between the feed gears 7 and fed by rotation of the feed gears. A feed motor (not shown) for rotating the feed gears 7 is provided in the binding machine main body 1. A battery pack 8 is provided in a lower portion of the binding machine main body 1, and the feed motor is activated by pulling a trigger 9.

Figure 3A:
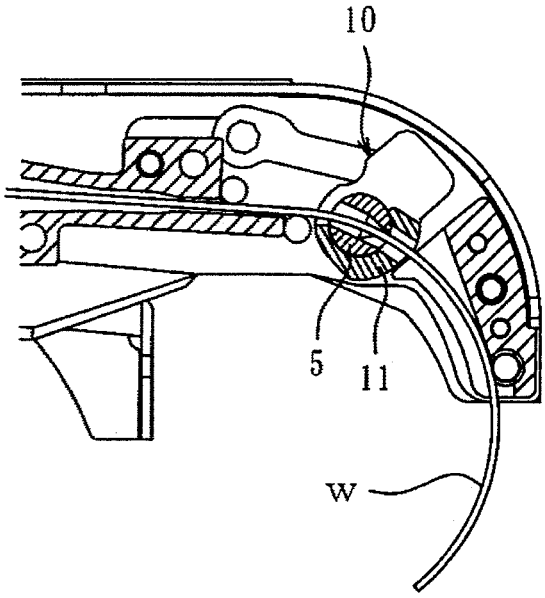
FIG. 3A and FIG. 3B are descriptive views of an operating mode of a wire cutting mechanism.
Figure 3B:
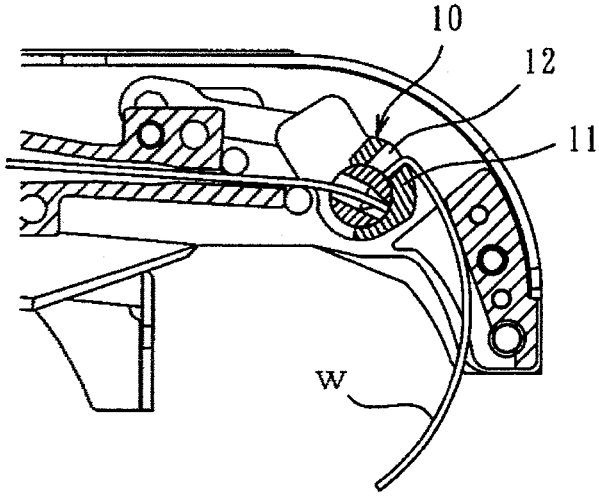

The wire cutting portion 4 is provided with a wire cutting mechanism. The wire cutting mechanism includes the cutting piece 5 and a rotary cutter 10 provided rotatably around the cutting piece 5. The cutting piece 5 assumes a short columnar shape. The wire through hole 3*c* is formed in a center of the cutting piece 5 in a penetrating manner. The rotary cutter 10 is fitted so as to be rotatable around the cutting piece 5. A shear wall 11 is formed in a portion of the rotary cutter 10. A shear port 12 is formed in the shear wall 11. An extension 13 is formed in a portion of the rotary cutter 10. The extension 13 is joined to an actuation arm 14. The rotary cutter 10 is rotated by pulling and pushing the actuation arm 14. In a standby state (at an initial position of the rotary cutter 10), the wire through hole 3*c* of the cutting piece 5 is aligned to the shear port 12 of the cutter 10, so that a wire "w" can pass through the through hole and the port. The rotary cutter 10 is moved to a cutting position by pulling the actuation arm 14 and rotating the rotary cutter 10. As shown in FIGS. 3A and 3B, when the rotary cutter 10 is situated at the cutting position, the shear port 12 traverses an open end of the wire through hole 3*c* of the cutting piece 5. The wire "w" inserted into the through hole 3*c* is thereby sheared, and the shear wall 11 shuts off the wire through hole 3*c*.

A guide arm 15 that imparts curled nature to the wire "w" fed by the feed gears 7 and then feeds the thus-coiled wire in a downward direction and a lower guide arm 16 for guiding the wire "w" fed by the guide arm 15 so as to again return to an elevated, predetermined position of the guide arm 15 are provided to project from a front end of the binding machine main body 1. A curl guide 6 is provided on a sidewall of the guide arm 15. A leading edge of the wire "w" passed through the cutting piece 5 butts against a guide surface 17 of the curl guide 6 formed at an angle with respect to a direction for feeding the wire "w," to thus become bent and imparted with curled nature. The leading edge is bent into a loop shape ahead of the guide surface. The wire is caused to lap and wind around reinforcing bars (not shown) into a loop shape between the guide surface and the lower guide arm 16.

Moreover, the binding machine main body 1 is provided with a twisting hook (a twisting mechanism). The twisting hook is configured so as to grip the wire wound around the reinforcing bars in the loop shape, to rotate to twist the wire and bind the reinforcing bars, and to reversely rotate, to thus leave the wire.

Rotation of the feed gears 7, cutting of the wire, operation of a wire twisting apparatus, and the like, are sequence-controlled by an unillustrated control circuit. The control circuit is also configured so as to measure an amount of wire feed according to an amount of rotation of the feed gears.

In the above configuration, when the reinforcing bars are bound, the feed motor is activated by pulling the trigger 9. The wire feed gears 7 of the wire feed mechanism are thereby rotated, and the wire of the wire reel is sent from the guide pipe 3*a* and the constricted passageway 3*b* toward the guide arm 15 by way of the wire through hole 3*c* of the wire cutting portion 4. Since the curl guide 6 of the guide arm 15 is inclined with respect to the direction of feeding of the wire "w". Hence, the wire "w" butts against the curl guide 6, to thus be bent and imparted with curled nature. Therefore, the wire fed ahead of the guide arm 15 is wound around the reinforcing bars so as to draw a loop. When the wire is fed in a predetermined amount, the wire cutting mechanism is activated, whereby the rotary cutter 10 rotates, to thus cut (shear) a root side of the wire "w," as shown in FIGS. 3A and 3B. Concurrently, a portion of the wire wound by the twisting hook (not shown) is twisted, thereby tightly binding the reinforcing bars. Binding operation thus ends.

As mentioned above, the binding operation of the reinforcing bar binding machine is performed by means of three consecutive operations; namely, activating the wire feed gears 7, to thus feed the wire "w" in a predetermined amount, cutting the wire "w" by means of the wire cutting mechanism, and activating the wire twisting hook, to thus twist the wire "w."

Incidentally, when an amount of wire remaining in the wire reel becomes empty, the wire reel must be replaced. After replacement of the wire reel, initializing operation is carried out before performing a first binding operation, thereby locating a position of the point of origin of a start end of a wire of the wire reel. Accordingly, during an initializing operation, ordinary routine operation is changed in terms of a sequence of operation. First, the rotary cutter 10 of the wire cutting mechanism is moved to the cutting position, where the wire through hole 3*c* of the cutting piece 5 is shut off. Subsequently, the rotary cutter 10 is returned to its initial position, and the wire feed mechanism is activated.

Figure 4:
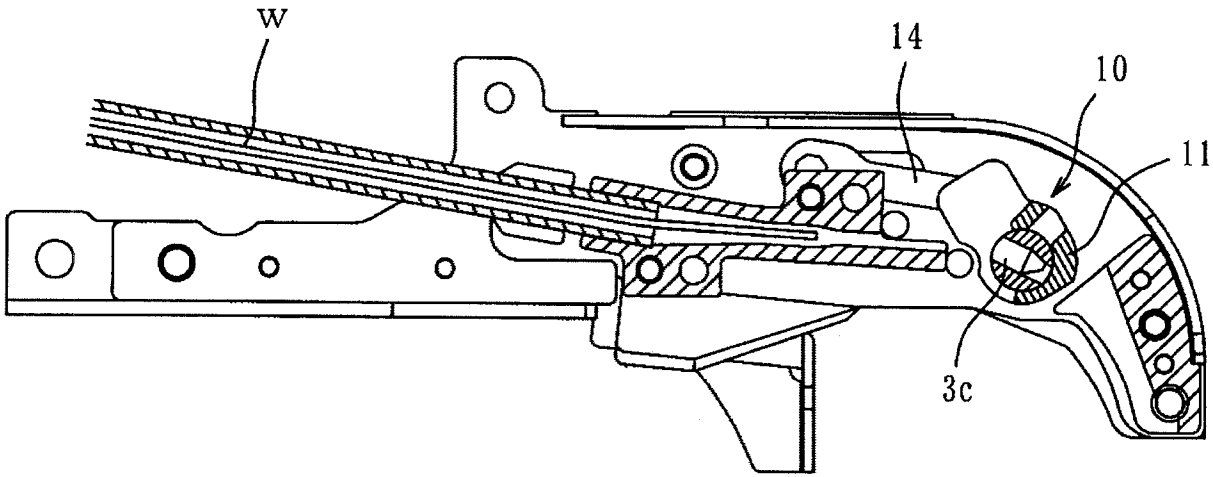
FIG. 4 is a descriptive view of an operating mode of a cutter achieved during initialization of the machine.
Figure 5:
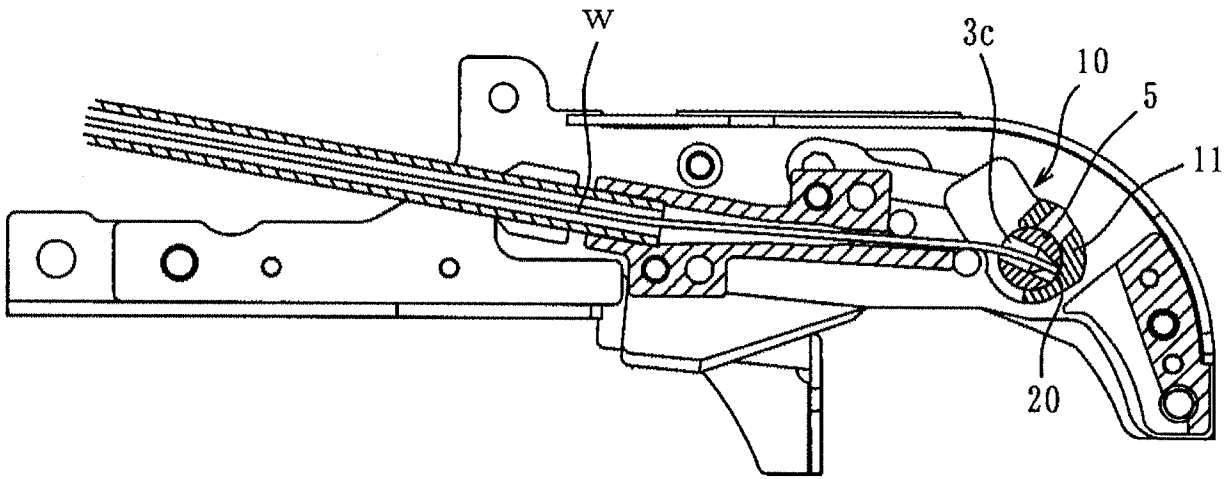
FIG. 5 is a descriptive view of a wire feed mode achieved during initialization of the machine.
Figure 6:
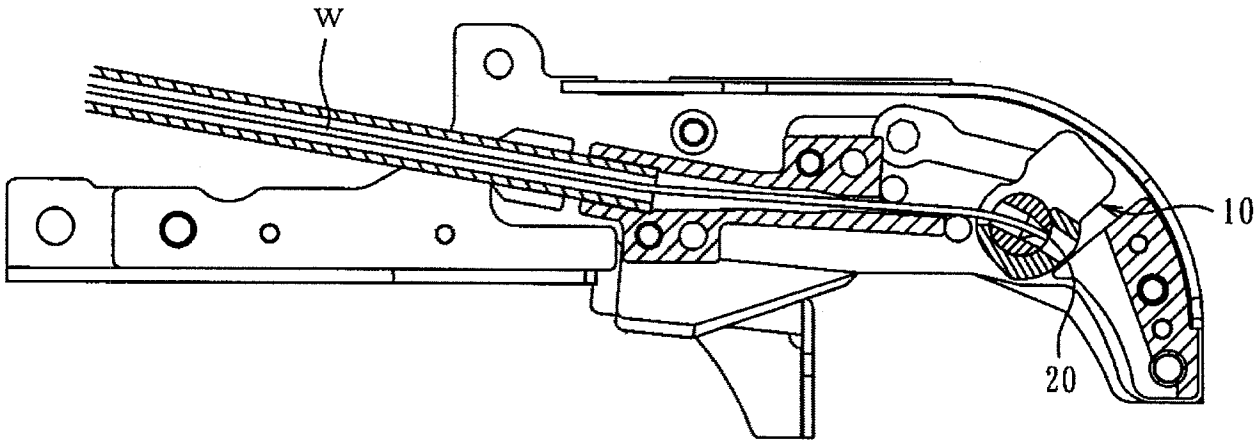
FIG. 6 is a descriptive view of an end status of initializing operation.

As shown in FIG. 2, the start end of the wire "w" of the wire reel is inserted from the guide pipe 3*a* of the wire and fed to a position where the wire passes through the space between the feed gears 7 by hand, whereby the wire is set. The trigger 9 is pulled, whereby the wire cutting mechanism first starts as shown in FIG. 4, thereby pulling the actuation arm 14. The rotary cutter 10 is thereupon rotated, to thus perform cutting operation. The shear wall 11 of the rotary cutter 10 shuts off the through hole 3*c* of the cutting piece 5 making up the wire passageway. When the wire feed gears 7 are subsequently activated, the wire "w" is fed from the wire reel. As shown in FIG. 5, a leading end 20 of the wire butts against the shear wall 11 of the rotary cutter 10 when passing through the wire through hole 3*c* because the shear wall acts as a barrier, so that further feeding of the wire is regulated. Accordingly, operation of the wire feed gears 7 is stopped, and the rotary cutter 10 is returned to its initial position, as shown in FIG. 6. The leading end 20 of the wire "w" thereby comes to a stop at the cutting portion, and locating the position of the point of origin of the wire is completed.

When the first binding operation is subsequently performed, three consecutive operations; namely, feeding the wire in a predetermined amount by the wire feed mechanism, cutting the wire by means of the wire cutting mechanism, and twisting the wire by means of the wire twisting hook, are performed, whereby the reinforcing bars are bound. In this case, the wire is fed in a predetermined amount, so that binding is appropriately performed.

There may also be adopted a configuration such that, when the wire reel is replaced, a new wire is caused to pass through the space between the wire feed gears 7 and such that a power switch 21 is turned on, thereby automatically performing the initializing operation. The reinforcing bar binding machine may also be equipped with a reel sensor that detects whether the wire reel is loaded to the binding machine main body or not, and a replacement of a wire reel may also be determined by detection of the reel sensor. A means for sensing that the leading end of the wire butts against the rotary cutter 10 can also be formed from a sensor, like a photosensor, a microswitch, and the like. Further, detecting that a motor is locked by a motor current may also be performed.

As mentioned above, according to the initialization method, whoever performs initialization, a snippet of a wire will not occur. Everybody can align the leading end of the wire to the fixed position, thereby locating the position of the point of origin of the wire. Since the wire will not protrude ahead of the rotary cutter 10, an unwanted small piece of the wire will not arise. Therefore, occurrence of wire jams and wasteful use of a wire can be eliminated, and rubbish does not arise. Further, a special member and a special mechanism are not required, and only requirement is to change the sequence of ordinary binding operation, which does not entail any substantial cost. So long as the wire is inserted slightly ahead of the wire feed gears 7, the wire is automatically fed to a specified position, which eases operation.

The configuration of the wire cutting mechanism is not limited to the above mode. Any cutting mechanism may also be adopted, so long as the mechanism is configured so as to be able to shut off the wire passageway.

According to the embodiment of the present invention, the method for activating the reinforcing bar binding machine includes the initializing operation. During the initializing operation, the wire passageway is shut off by the cutter of the wire cutting mechanism. The wire is fed by a wire feed mechanism while the wire passageway is shut off. When the leading end of the wire butts against the cutter, the wire feed mechanism is stopped.

Therefore, whoever performs initializing operation, a snippet of a wire will not occur, and everybody can align the leading end of the wire to the fixed position, thereby locating the position of the point of origin of the wire.

Since all you have to do is to feed, by hand, the wire to a position where the wire can be fed by the wire feed mechanism, the wire will not protrude ahead of the cutter. For this reason, an unwanted small piece of the wire does not occur. Consequently, occurrence of wire jams and wasteful use of the wire can be eliminated, and rubbish will not arise, either.

Further, a special member and a special mechanism are not required, and initializing operation can be performed by changing only the sequence of ordinary binding operation, so that any substantial cost is not entailed. So long as the wire is inserted over a small distance to the pipe entrance, the wire is automatically fed to a specified position, which eases operation.

In the embodiment of the present invention, the operating method of the reinforcing bar binding machine may also include the binding operation. During the binding operation, the wire feed mechanism feeds a wire, and the wire is wound around the reinforcing bars. The wire is cut at a position between the wire reel and a portion of the wire wound around the reinforcing bars by the wire cutting mechanism. A portion of the wound wire is gripped and twisted, whereby the reinforcing bars are bound.

The wire cutting mechanism may also include a cutting piece having a wire through hole making up a portion of the wire passageway and the cutter that can rotate around the cutting piece. The cutter may also be able to move between a cutting position where the wire through hole is shut off and the initial position where the wire through hole is opened. When the cutter is situated at the initial position, the wire can also be fed through the wire through hole. In a state where the wire is inserted into the wire through hole, the wire may also be cut by moving the cutter to the cutting position. In a step of shutting off the wire passageway during initializing operation, the cutter is placed at the cutting position while the wire is not inserted into the wire through hole, whereby the wire passageway may also be shut off.

The initializing operation may also include a step of moving the cutter to thus open the wire passageway, after the step of deactivating the wire feed mechanism when the leading end of the wire butts against the cutter.

In the step of moving the cutter to open the wire passageway, the wire passageway may also be opened by placing the cutter at the initial position.

Before the binding operation is performed after replacement of the wire reel, the initializing operation may also be performed.

The reinforcing bar binding machine may also include a reel sensor for detecting attachment of the wire reel to the binding machine main body. Replacement of the wire reel may also be determined by detection of the reel sensor.

The reinforcing bar binding machine may have a main switch. The initializing operation may also be performed as a result of turning on of the power switch.

DESCRIPTION OF REFERENCE NUMERALS AND SIGNS w WIRE
1 BINDING MACHINE MAIN BODY
7 WIRE FEED GEAR (WIRE FEED MECHANISM)
4 WIRE CUTTING PORTION
6 CURL GUIDE
10 ROTARY CUTTER
15 GUIDE ARM

What is claimed is:

1. An operating method of a reinforcing bar binding machine including a wire feed mechanism for feeding a wire from a wire reel rotatably disposed on a binding machine main body and a wire cutting mechanism for cutting the wire at a position between the wire reel and a portion of the wire wound around reinforcing bars after the wire has been fed and wound around the reinforcing bars, the operating method comprising:

an initializing operation that includes:

shutting off a wire passageway defined by a wire through hole in a cutting piece and by a wire shear port extending entirely through a cutter of the wire cutting mechanism by rotating the cutter around the cutting piece to misalign the wire shear port of the cutter from the wire through hole of cutting piece;

feeding the wire by the wire feed mechanism while the wire passageway remains shut off; and deactivating the wire feed mechanism when a leading end of the wire butts against the cutter.

2. The operating method according to claim 1, further comprising a binding operation after the initializing operation, wherein the binding operation includes:

feeding the wire by the wire feed mechanism, to thus wind the wire around the reinforcing bars, cutting the wire at the position between the portion of the wire wound around the reinforcing bars and the wire reel by the wire cutting mechanism, and gripping and twisting a portion of the wound wire, thereby binding the reinforcing bars.

3. The operating method according to claim 2, wherein the cutter is movable between a cutting position where the wire through hole is shut off and an initial position where the wire through hole is opened;

the wire is fed through the wire through hole and the shear port when the cutter is situated at the initial position, and the wire is cut by moving the cutter to the cutting position while the wire is inserted into the wire through hole and the shear port; and the cutter is situated at the cutting position while the wire is not inserted into the shear port in said step of shutting off the wire passageway during the initializing operation, thereby shutting off the wire passageway.

4. The operating method according to claim 3, wherein the initializing operation includes a step of moving the cutter to the initial position after the step of deactivating the wire feed mechanism when the leading end of the wire butts against the cutter.

5. The operating method according to claim 2, wherein said initializing operation is performed after a replacement of the wire reel and before the binding operation is performed.

6. The operating method according to claim 5, wherein the reinforcing bar binding machine includes a reel sensor for detecting whether the wire reel is mounted on the binding machine main body, and the replacement of the wire reel is determined by a detection of the reel sensor.

7. The operating method according to claim 1, wherein the reinforcing bar binding machine includes a power switch, and said initializing operation is performed when the power switch is turned on.

* * * * *